US011607783B2

(12) United States Patent
Su

(10) Patent No.: US 11,607,783 B2
(45) Date of Patent: Mar. 21, 2023

(54) CIRCLIP PLIERS

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 232 days.

(21) Appl. No.: 17/082,277

(22) Filed: Oct. 28, 2020

(65) Prior Publication Data

US 2021/0170558 A1 Jun. 10, 2021

(30) Foreign Application Priority Data

Dec. 4, 2019 (TW) ..... 108144320

(51) Int. Cl.
*B25B 27/20* (2006.01)

(52) U.S. Cl.
CPC ..... *B25B 27/205* (2013.01)

(58) Field of Classification Search
CPC .... B25B 7/02; B25B 7/04; B25B 7/06; B25B 7/08; B25B 7/10; B25B 7/12; B25B 27/205; B25B 27/20; Y10T 29/5363
See application file for complete search history.

(56) References Cited

U.S. PATENT DOCUMENTS 4,316,315 A * 2/1982 Vogelnik ..... B25B 27/205 D8/54
6,257,105 B1 * 7/2001 Lin ..... B25B 27/205 29/229
6,470,774 B2 10/2002 Chang
10,421,178 B2 9/2019 Engel et al.
2011/0154958 A1 * 6/2011 Wang ..... B25B 27/0071 81/302
2017/0001295 A1 1/2017 Sun

FOREIGN PATENT DOCUMENTS

| | | | |
|---|---|---|---|
| CN | 104742090 A | | 7/2015 |
| CN | WO 2019/195983 | * | 10/2019 |
| DE | 0794039 | * | 9/1997 |
| GB | 728681 A | | 4/1995 |
| TW | 272477 | | 3/1996 |
| TW | 299697 U | | 3/1997 |
| TW | M271674 U | | 8/2005 |
| TW | M385448 U | | 8/2010 |
| TW | M445482 U | | 1/2013 |
| TW | M522818 U | | 6/2016 |

* cited by examiner

*Primary Examiner* — Robert J Scruggs
(74) *Attorney, Agent, or Firm* — Alan D. Kamrath; Karin L. Williams; Mayer & Williams PC

(57) ABSTRACT

Circlip pliers comprise a first plier and a second plier. The first plier is provided with an external connection portion, an internal connection portion, and a pivot portion located between the external connection portion and the internal connection portion. The second plier is provided with an external connection portion, an internal connection portion, and a second pivot portion located between the second external connection portion and the second internal connection portion. The external connection portions are adapted to insert into grip holes in an external circlip. The internal connection portions are adapted to insert into grip holes in an internal circlip. The first and second pivot portions are pivotally connected with each other.

6 Claims, 7 Drawing Sheets

CIRCLIP PLIERS

BACKGROUND OF THE INVENTION

The present invention relates to circlip pliers and, more particularly, to circlip pliers designed for installing and removing both external and internal circlips.

Circlips are generally deployed where components are required to be kept fitted on shafts or housings. Circlips tend to have open ends, rather than being a complete ring. This open-ended design gives them a certain amount of spring tension. Once fitted in place, the spring pressure effect ensures that they don't move or slip out of place. The majority of circlips feature a hole in a lug at either end, which allows for the installation or removal of the circlip plier tips. Circlip pliers, or circlip removers, are therefore an essential piece of a kit for anyone who works with this type of fastener.

However, external and internal circlips are subtly different types of fasteners. Each requires a slightly different tool in order to be manipulated successfully.

External circlips are made to fit around the outside of a shaft or dowel, usually seated in a groove. Once in place, they exert their spring pressure inwards towards the dowel as a means of providing grip. External circlips, therefore, need to be opened up for installation, using external circlip pliers. This allows the ring to expand slightly and fit more easily over the dowel or shaft.

Internal circlips are designed to be fitted inside a hollow, cylindrical housing or bore. The spring action pushes outward against the sides, so it's a radiating pressure that holds the ring in place. Internal circlip pliers work the opposite way to external versions.

Therefore, the user must carry at least two type of circlip pliers in order to correspond to various types of circlips.

Thus, a need exists for novel circlip pliers that mitigates and/or obviates the above drawbacks.

BRIEF SUMMARY OF THE INVENTION

An objective of the present invention is to provide circlip pliers for installing and removing both internal circlips and external circlips.

Circlip pliers according to the present invention include a first plier and a second plier. The first plier is provided with a first external connection portion, a first internal connection portion, and a first pivot portion. The first external connection portion and the first internal connection portion are respectively located at two opposite ends of the first plier. The first pivot portion is located between the first external connection portion and the first internal connection portion. The second plier is provided with a second external connection portion, a second internal connection portion, and a second pivot portion. The second external connection portion and the second internal connection portion are respectively located at two opposite ends of the second plier. The second pivot portion is located between the second external connection portion and the second internal connection portion. The first and second external connection portions are adapted to insert into grip holes in an external circlip. The first and second internal connection portions are adapted to insert into grip holes in an internal circlip. The first and second pivot portions are pivotally connected with each other.

In an example, the first and second external connection portions are spaced from each other to define a first distance. The first and second internal connection portions are spaced from each other to define a second distance. The first distance is less than the second distance when the first and second pliers are in a normal state without external force.

In an example, the first plier is provided with a first press portion located between the first internal connection portion and the first pivot portion. The second plier is provided with a second press portion located between the second internal connection portion and the second pivot portion. The first and second press portions are adapted to be applied force to cause the first and second pliers pivoted to each other, so that the first distance is increased and the second distance is shortened.

In an example, the first pivot portion has a first through hole penetrating therethrough. The second pivot portion has a second through hole penetrating therethrough. A torsion spring is disposed between the first and second pivot portions and is abutted against the first and second pliers, and a pivot pin is inserted through the first and second through holes and the torsion spring.

In an example, the circlip pliers further include two metal reinforce members respectively embedded in the first and second pliers.

In an example, each of the two metal reinforce members is formed as an irregular shaped elongated plate.

In an example, the first external connection portion and the first internal connection portion are respectively removably mounted at two opposite ends of the first plier via two first fasteners. The second external connection portion and the first internal connection portion are respectively removably mounted at two opposite ends of the second plier via two second fasteners. Each of the two metal reinforce members has a first end, a second end opposite to the first end, a third pivot portion disposed between the first pivot portion and the second pivot portion, and a turning portion located between the second end and the third pivot portion. The two first fasteners are respectively inserted through the first plier, the first external connection portion and the first internal connection portion, and the first end and the second end of one of the two metal reinforce members. The two second fasteners are respectively inserted through the second plier, the second external connection portion and the second internal connection portion, and the first end and the second end of the other of the two metal reinforce members.

The present invention will become clearer in light of the following detailed description of illustrative embodiments of this invention described in connection with the drawings.

DETAILED DESCRIPTION OF THE INVENTION

Figure 1:
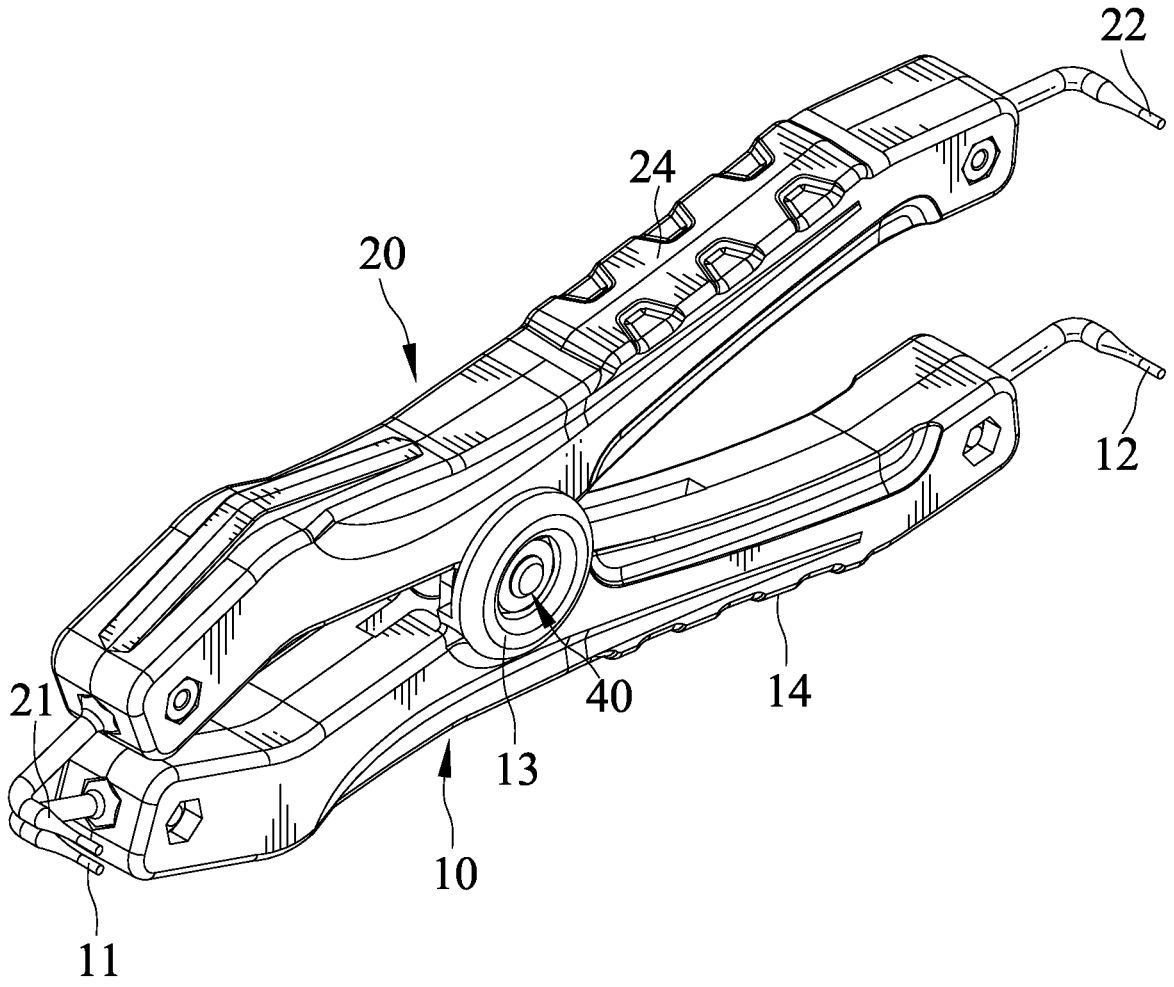
FIG. 1 is a perspective view of circlip pliers of an embodiment according to the present invention.
Figure 2:
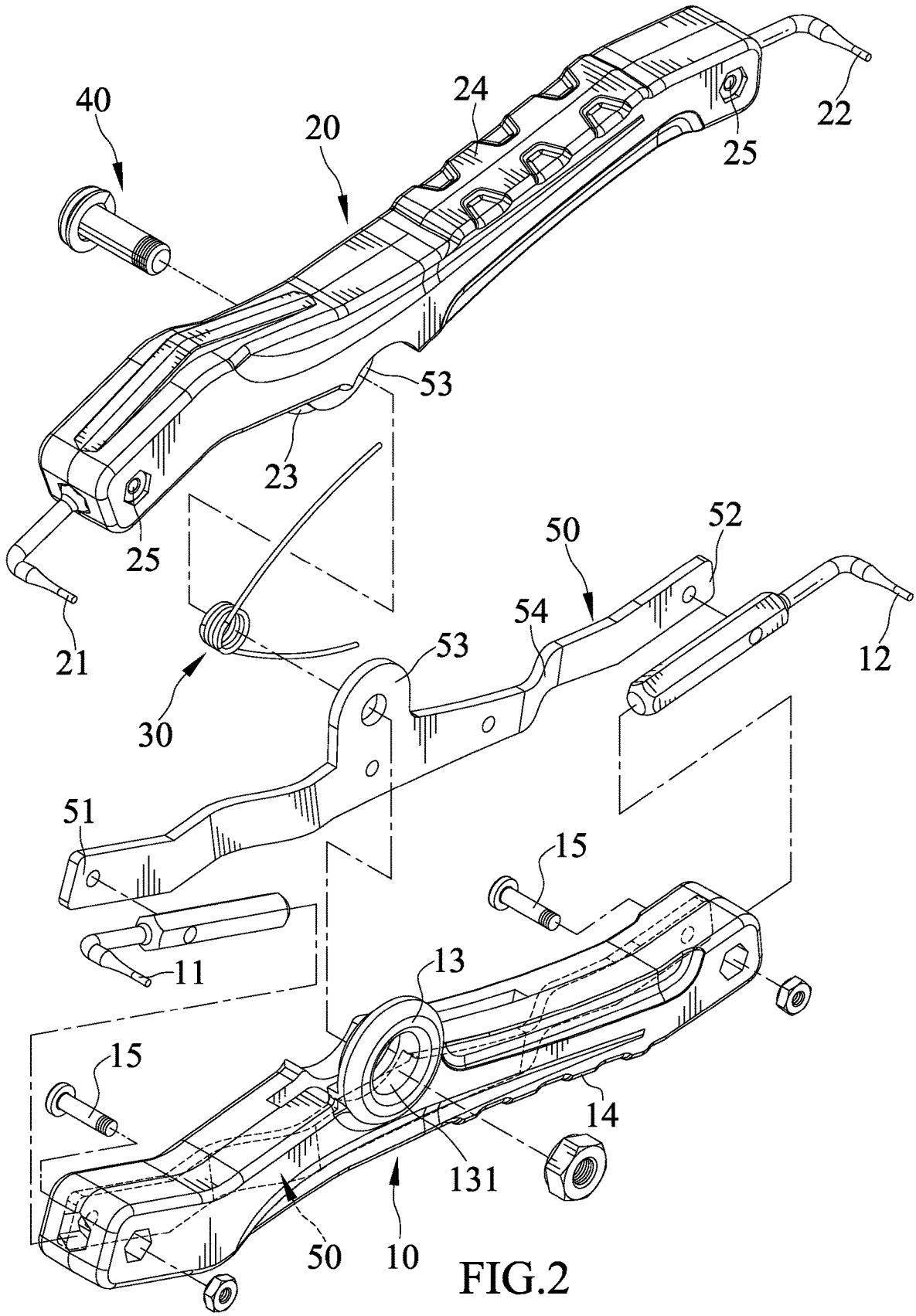
FIG. 2 is an exploded, perspective view of the circlip pliers of FIG. 1.
Figure 3:
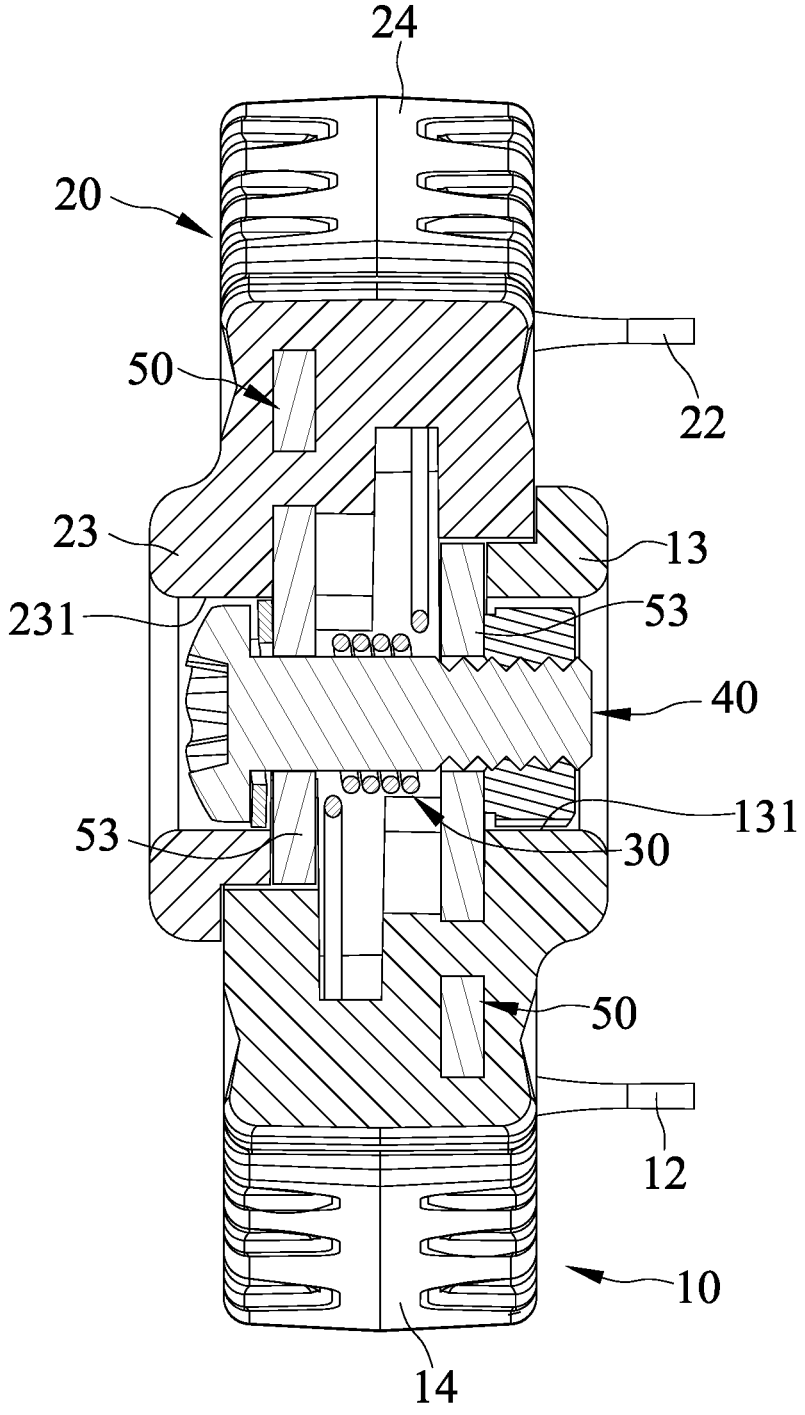
FIGS. 3-5 are cross sectional views of the circlip pliers of FIG. 1.

With reference to FIGS. 1-7, circlip pliers of an embodiment according to the present invention includes a first plier 10 and a second plier 20.

The first plier 10 is provided with a first external connection portion 11, a first internal connection portion 12, a first pivot portion 13, and a first press portion 14. The first external connection portion 11 and the first internal connection portion 12 are respectively located at two opposite ends of the first plier 10. The first pivot portion 13 is located between the first external connection portion 11 and the first internal connection portion 12. The first press portion 14 is located between the first internal connection portion 12 and the first pivot portion 13.

The second plier 20 is provided with a second external connection portion 21, a second internal connection portion 22, a second pivot portion 23, and a second press portion 24. The second external connection portion 21 and the second internal connection portion 22 are respectively located at two opposite ends of the second plier 20. The second pivot portion 23 is located between the second external connection portion 21 and the second internal connection portion 22. The second press portion 24 is located between the second internal connection portion 22 and the second pivot portion 23.

In the embodiment, the first external connection portion 11 and the first internal connection portion 12 are respectively removably mounted at two opposite ends of the first plier 10 via two first fasteners 15. Likewise, the second external connection portion 21 and the second internal connection portion 22 are respectively removably mounted at two opposite ends of the second plier 20 via two second fasteners 25. Thus, the user can replace the first and second external connection portions 11 and 21, and the first and second internal connection portions 12 and 22 to correspond to circlips.

The first and second external connection portions 11 and 21 are adapted to insert into grip holes C11 in an external circlip C1. The first and second internal connection portions 12 and 22 are adapted to insert into grip holes C21 in an internal circlip C2. The first and second pivot portions 13 and 23 are pivotally connected with each other so that the first and second pliers 10 and 20 can be pivoted toward each other.

Figure 4:
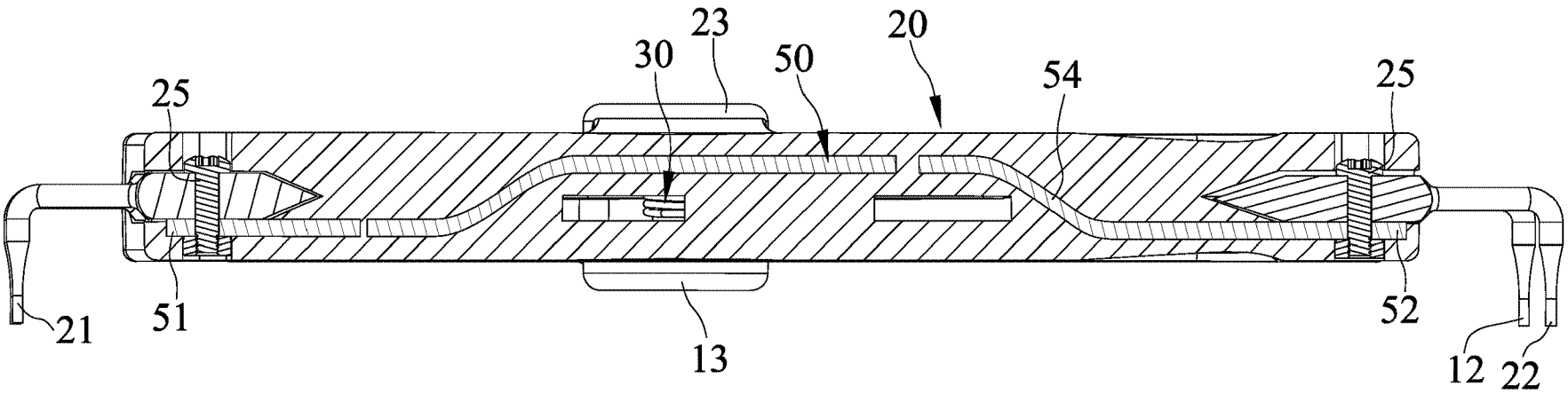
Figure 5:
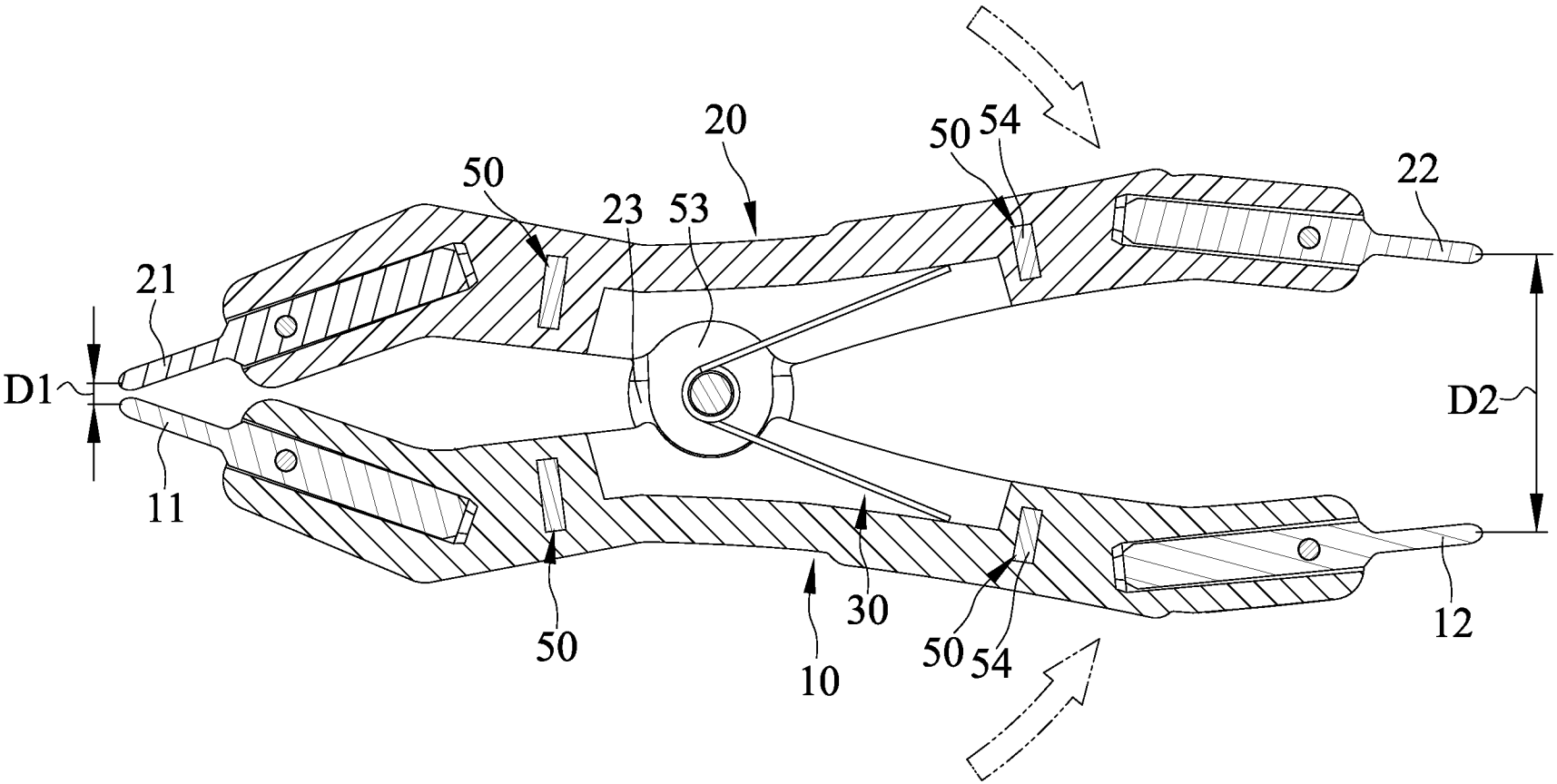

The first and second external connection portions 11 and 21 are spaced from each other to define a first distance D1, and the first and second internal connection portions 12 and 22 are spaced from each other to define a second distance D2. As shown in FIG. 4, the first distance D1 is less than the second distance D2 when the first and second pliers 10 and 20 are in a normal state without external force. As shown is FIGS. 5 and 6, the first and second press portions 14 and 24 are adapted to be applied force to cause the first and second pliers 10 and 20 pivoted to each other, so that the first distance D1 is increased and the second distance D2 is shortened.

The first pivot portion 13 has a first through hole 131 penetrating therethrough, and the second pivot portion 23 has a second through hole 231 penetrating therethrough. A torsion spring 30 is disposed between the first and second pivot portions 13 and 23 and is abutted against the first and second pliers 10 and 20. A pivot pin 40 is inserted through the first and second through holes 131 and 231 and the torsion spring 30.

The circlip pliers further includes two metal reinforce members 50 respectively embedded in the first and second pliers 10 and 20 to achieve an increased structural strength. Further, each metal reinforce member 50 is formed as an irregular shaped elongated plate and has a first end 51, a second end 52 opposite to the first end 51, a third pivot portion 53 disposed between the first pivot portion 13 and the second pivot portion 23, and a turning portion 54 located between the second end 52 and the third pivot portion 53. The two first fasteners 15 are respectively inserted through the first plier 10, the first external connection portion 11 and the first internal connection portion 12, and the first end 51 and the second end 52 of one of the two metal reinforce members 50. The two second fasteners 25 are respectively inserted through the second plier 10, the second external connection portion 21 and the second internal connection portion 22, and the first end 51 and the second end 52 of the other of the two metal reinforce members 50.

Figure 6:
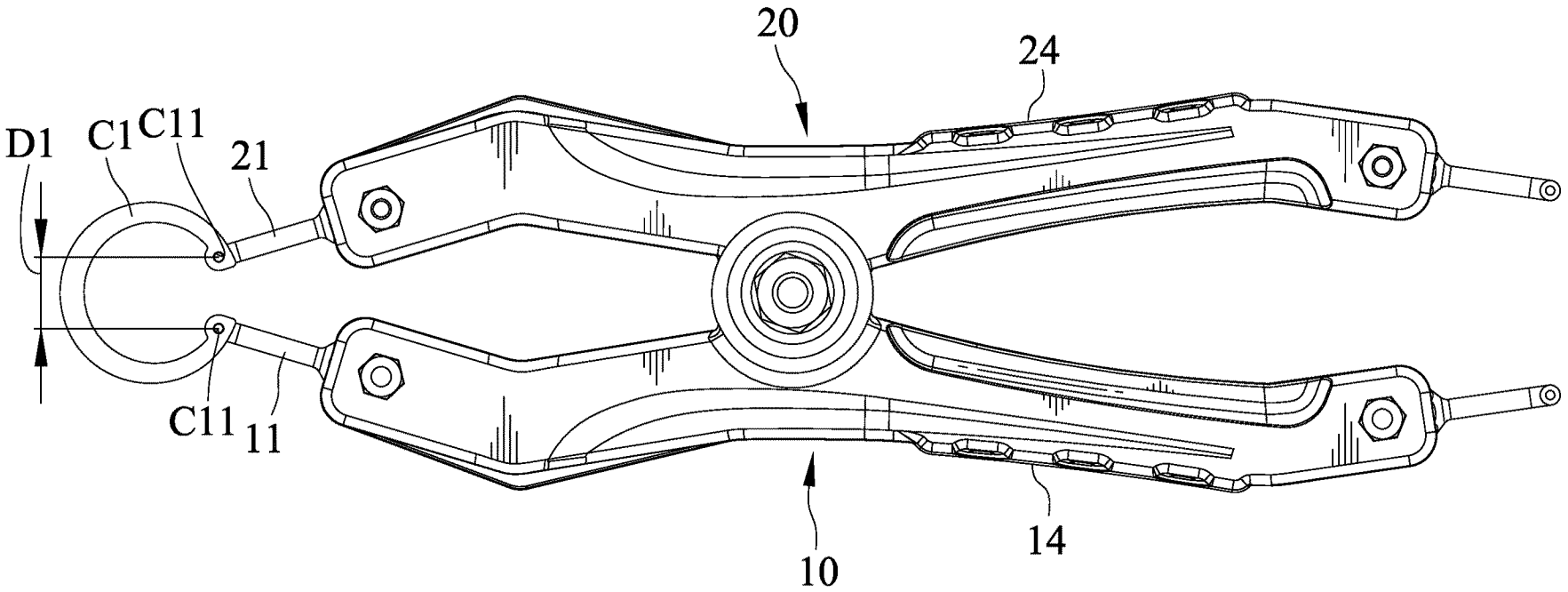
FIG. 6 is a side view of the circlip pliers of FIG. 1 and shows the circlip pliers to hold an external circlip.

As shown in FIG. 6, with the first and second external connection portions 11 and 21 inserted into grip holes C11 in an external circlip C1, squeezing the first and second press portion 14 and 24 results in the first and second external connection portions 11 and 21 opening up to increase the first distance D1. This stretches the external circlip C1 out slightly, allowing it to be slotted over a shaft.

Figure 7:
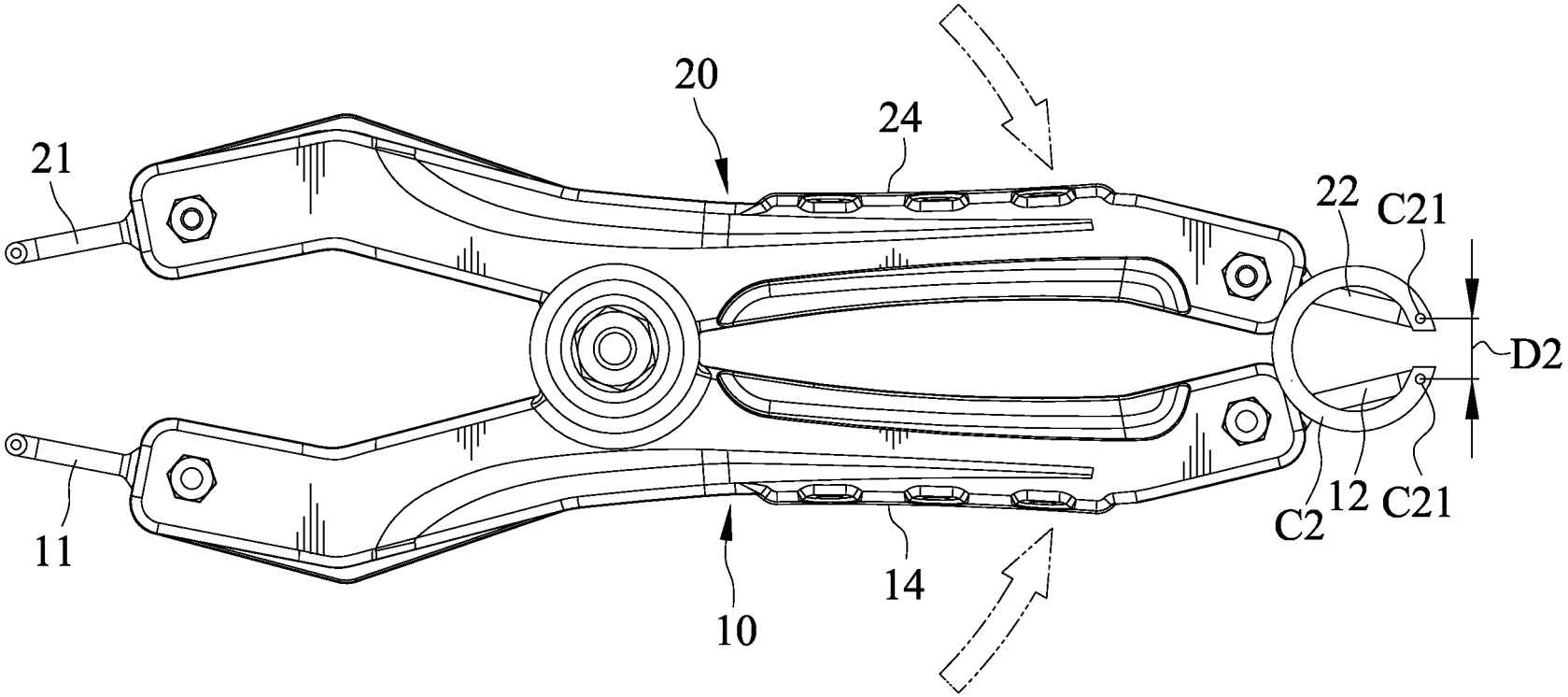
FIG. 7 is a side view of the circlip pliers of FIG. 1 and shows the circlip pliers to hold an internal circlip.

As shown in FIG. 7, with the first and second internal connection portions 12 and 22 inserted into grip holes C21 in an internal circlip C2, squeezing the first and second press portions 14 and 24 results in the first and second internal connection portions 12 and 22 closing together to reduce the second distance D2. Once the internal circlip C2 is in position, the first and second press peon 14 and 24 can be released, and the internal circlip C2 returns to its maximum diameter.

Thus, the circlip pliers of this embodiment can not only be applied to both the external circlip C1 and the internal circlip C2, but can also install and remove them by pressing the first and second press portions 14 and 24 in a single action to have the advantages of simple structure and convenient use.

Although specific embodiments have been illustrated and described, numerous modifications and variations are still possible without departing from the scope of the invention. The scope of the invention is limited by the accompanying claims.

The invention claimed is:

1. Circlip pliers comprising:

a first plier provided with a first external connection portion, a first internal connection portion, and a first pivot portion located between the first external connection portion and the first internal connection portion; and a second plier provided with a second external connection portion, a second internal connection portion, and a second pivot portion located between the second external connection portion and the second internal connection portion and pivotally connected with the first pivot portion, wherein the first plier is provided with a first press portion located between the first internal connection portion and the first pivot portion, wherein the second plier is provided with a second press portion located between the second internal connection portion and the second pivot portion, wherein the first and second press portions are adapted to be applied force to cause the first and second pliers pivoted to each other, so that the first distance is increased and the second distance is shortened, wherein the first pivot portion has a first through hole penetrating therethrough, wherein the second pivot portion has a second through hole penetrating therethrough, wherein a torsion spring is disposed between the first and second pivot portions and abuts against inner surfaces of the first and second press portions, and wherein a pivot pin is inserted through the first and second through holes.

2. The circlip pliers as claimed in claim 1, wherein the first and second external connection portions are spaced from each other to define a first distance, wherein the first and second internal connection portions are spaced from each other to define a second distance, and wherein the first distance is less than the second distance when the first and second pliers are in a normal state without external force.

3. The circlip pliers as claimed in claim 1, wherein the pivot pin is inserted through the torsion spring.

4. The circlip pliers as claimed in claim 3, further comprising two metal reinforce members respectively embedded in the first and second pliers.

5. The circlip pliers as claimed in claim 4, wherein each of the two metal reinforce members is formed as an irregular shaped elongated plate.

6. The circlip pliers as claimed in claim 5, wherein the first external connection portion and the first internal connection portion are respectively removably mounted at two opposite ends of the first plier via two first fasteners, and wherein the second external connection portion and the second internal connection portion are respectively removably mounted at two opposite ends of the second plier via two second fasteners, wherein each of the two metal reinforce members has a first end, a second end opposite to the first end, a third pivot portion disposed between the first pivot portion and the second pivot portion, and a turning portion located between the second end and the third pivot portion, wherein the two first fasteners are respectively inserted through the first plier, the first external connection portion and the first internal connection portion, and the first end and the second end of one of the two metal reinforce members, and wherein the two second fasteners are respectively inserted through the second plier, the second external connection portion and the second internal connection portion, and the first end and the second end of the other of the two metal reinforce members.

* * * * *